United States Patent [19]

Matuschek

[11] Patent Number: 5,035,041

[45] Date of Patent: Jul. 30, 1991

[54] METHOD TO OBTAIN PRELOAD IN SOLID ONE-PIECE DUCTILE RIVET INSTALLATION

[76] Inventor: Josip Matuschek, 1976 Port Dunleigh, Newport Beach, Calif. 92660

[21] Appl. No.: 540,279

[22] Filed: Jun. 19, 1990

[51] Int. Cl.[5] ..... B21P 11/00

[52] U.S. Cl. ..... 29/509; 29/525; 29/525.1

[58] Field of Search ..... 29/509, 525, 525.1

[56] References Cited

U.S. PATENT DOCUMENTS

| | | | |
|---|---|---|---|
| 3,526,032 | 9/1970 | Pipher | 29/525.1 X |
| 3,874,070 | 4/1975 | Falcioni | 29/509 X |
| 3,934,330 | 1/1976 | Briles | 29/509 |
| 4,048,708 | 9/1977 | Briles | 29/509 |
| 4,086,839 | 5/1978 | Briles | 85/37 |
| 4,223,433 | 9/1980 | Rosman | 29/509 |
| 4,493,141 | 1/1985 | Krezak | 29/509 |
| 4,528,739 | 7/1985 | Kemp | 29/509 |
| 4,630,463 | 12/1986 | Knowlton | 29/509 X |
| 4,688,317 | 8/1987 | Matuschek | 29/509 |
| 4,815,193 | 3/1989 | Gutnik | 29/509 |
| 4,904,137 | 2/1990 | Matuschek | 411/501 |

*Primary Examiner*—Timothy V. Eley
*Assistant Examiner*—C. Richard Martin
*Attorney, Agent, or Firm*—James Bartolomew

[57] ABSTRACT

The method of rivet installation creates a preload on the workpieces being joined. The installation steps include inserting a rivet into two or more workpieces to be joined and engaging the head of the rivet with an upper two piece tooling assembly while engaging the tail of the rivet with a counterbore provided in a lower tool. In phase one of installation, which follows these engagement steps, the lower tool exerts a compressive force upon the rivet tail, thereby deforming the tail to form a lower upset head. In phase two of installation, an inner retractable pin of the two piece tooling assembly is withdrawn from contact with the rivet head while an outer ring tool of the tooling assembly exerts a compressive force upon peripheral portions of the rivet head, thereby deforming the rivet head periphery to form an enlarged rim comprising an upper upset head. This deformation of the rivet head periphery produces a preload. Both phase one and phase two of installation are executed in one continuous motion.

11 Claims, 6 Drawing Sheets

METHOD TO OBTAIN PRELOAD IN SOLID ONE-PIECE DUCTILE RIVET INSTALLATION

BACKGROUND OF THE INVENTION

This invention relates to a method of installing a rivet in a plurality of workpieces, and to the resulting riveted joint, as well as the rivet itself.

One rivet type fastener commonly used in aircraft constructions includes a shank with a manufactured head on one end and a tail on the other end. In use, the tail end of the shank is inserted through aligned holes of two or more workpieces with the rivet head engaging the outer face of one of the workpieces and with the tail extending beyond the outer faces of the other workpiece. The tail is then deformed by means of an axial force, compressing the rivet axially and upsetting the tail material outwardly to form an upset head which is larger in diameter than the hole through the workpieces, so that the two workpieces are fastened together. One widely used rivet of this general type is of the bi-metallic variety, comprising a shank made of a strong material which is high in shear strength and a tail made of a more ductile material which is easier to deform than the shank.

All types of fasteners having a tail to be upset are often installed by squeezing, wherein the ductile tail is compressed until the upset head is formed therefrom. A general problem associated with rivet installation of this type is that when the squeezing force used to form the upset head is released, the column of the rivet shank "springs back" or lengthens a certain distance due to elastic memory. Although the material of the workpiece being fastened also springs back, most of the materials in common use do not spring back as much as the rivet shank, with the result that a small gap is created between portions of the upset head and the workpiece after the installation is complete. This gap is undesirable in that it provides a location for moisture to collect, thereby promoting corrosion of the workpiece. Moreover, this gap is unacceptable for applications where the workpiece and fastener are to be subjected to high fatigue loads.

In aircraft structures, particularly those involving tension fatigue loading of the fastener, it is desirable that the gap between the upset head and the workpiece be zero. This is in part because, with the gap eliminated, the upset head will be flush with the underlying workpiece, thereby providing an improved aerodynamic profile for the aircraft structure. Ideally, the underside of the upset head should exert a compression force against the workpiece after the installation. When such a loading is achieved, the fastener is said to exert a residual tension force against the workpiece after installation. This loading is often referred to as a "preload" in the joint. The advantages of preload are especially desirable in aircraft construction because preload provides for a higher fatigue life of the joint and provides excellent protection against corrosion because it becomes difficult for a corroding substance to infiltrate inner surfaces of the joint.

A general problem in this area is an inability to obtain a predictable, measured preload in a fastened or riveted joint. For example, preload is obtainable with conventional two piece fasteners, such as a nut and bolt, but it is very difficult to quantify the amount of preload achieved because of other factors present such as friction, type of materials, etc. Moreover, two piece fasteners present serious feeding problems when automatic or robotic installation is attempted. Thus, although a difficult to quantify preload is achievable with two piece fasteners, use of such fasteners is still not as preferred as one piece fasteners in the aircraft industry because automated fastener installation of one piece fasteners is the preferred mode in aircraft construction due to the lower costs and improved installation uniformity associated therewith. One prior practice which attempts to address the problem of providing preload in a riveted joint involves the use of hot rivets which, after being upset, contract upon cooling and produce the desired preload in the joint. However, this hot rivet approach is not a practical method for obtaining preload in aircraft structures because of the higher costs and complexities associated therewith.

A one-piece fastener is particularly desirable as opposed to a two-piece fastener in that it is easy to feed and install using automatic equipment. A predominant type of one-piece fastener in use is the afore-mentioned bi-metallic rivet having a strong shank and a ductile tail. However, an inability to provide a preload had previously been encountered with the use of bimetallic rivets. This drawback was addressed in Applicant's prior U.S. Pat. Nos. 4,688,317 and 4,904,137, incorporated herein by reference. Unfortunately, the teachings of Applicant's above-noted prior patents apply best when the rivet to be installed comprises a manufactured head (such as 55 Ti 45 Cb titanium alloy) which is much harder than the shank material (i.e. a bi-metallic rivet). Thus, a method of obtaining preload during the installation of solid ductile rivets, rather than bimetalic rivets, is an area which has yet to be addressed in an ideal manner. The widespread use of standard solid ductile rivets in the aerospace industry today requires that an effective method of obtaining preload in solid, one-piece ductile rivet installation be achieved.

There exists therefore, a significant need for a method of installing a solid one-piece ductile rivet or shear pin fastener in a manner which can provide a significant axial preload. Moreover, such a method is needed which allows for automated rivet installation using machines, and which enables a predictable, quantifiable preload to be obtained. Further, such a method is needed which is compatible for use with universal head rivets as well as with flush head rivets. The present invention fulfills these needs and provides further related advantages.

SUMMARY OF THE INVENTION

In accordance with the invention, a method is provided for installing rivets in a manner subjecting a riveted workpiece to a preload while avoiding the noted drawbacks of prior fastener installation methods. The inventive method ensures the achievement of a preload, in part because it provides for the deformation of both head and tail portions of a rivet, thereby creating both an upper and lower upset head respectively.

The present invention advantageously provides for the achievement of a preload that is quantifiable and predictable because of a calibratable relationship between the size of the upset heads formed and the amount of preload obtained. Moreover, the method of the present invention beneficially is compatible with solid ductile rivets having universal heads and flush heads, and can be executed by automatic riveting machines.

In one preferred form of the invention, the method is initiated by inserting a rivet through aligned holes in two or more workpieces and positioning an upper two piece tooling assembly proximate a head portion of the rivet and a lower tool having a counterbore surface proximate a tail portion of the rivet.

Next, the upper and lower tools simultaneously engage the rivet head and tail respectively. The upper two piece tooling assembly comprises an inner tool which exerts an axially compressive force upon the rivet head and an outer tool which exerts a compressive force upon peripheral portions of the rivet head. While the upper tool is exerting these compressive forces, the lower tool deforms the rivet tail with an axially compressive force supplied by its counterbore surface, thereby forming a lower upset head.

Phase two of installation begins with retraction of the upper inner tool from engagement with the rivet head, thereby discontinuing the axially compressive force applied to the rivet head by this tool while the upper outer tool and lower tool continue to exert compressive forces to peripheral rivet head portions and the lower upset head, respectively. Phase two is completed when the upper outer tool applies compressive forces sufficient to deform the peripheral rivet head portions in a manner creating an enlarged rim about the rivet head, thereby creating an upper upset head. The upper and lower upset heads act to exert a preload upon the workpieces which have been riveted together.

Other features and advantages of the present invention will become more apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 17(*a*) is an enlarged, cross section prior art view of a portion of the rivet head which is circled in FIG. 17, illustrating (with arrows) the flow of the material in the rivet head during the formation of the upset head rim shown in FIG. 17;

FIG. 17(*b*) is an enlarged, cross section prior art view of a portion of the lower upset head rim which is circled in FIG. 17, illustrating (with arrows) the flow of the material from the rim of the lower upset head during the end of the second phase shown in FIG. 17.

DETAILED DESCRIPTION OF THE PREFERRED EMBODIMENT

Figure 1:
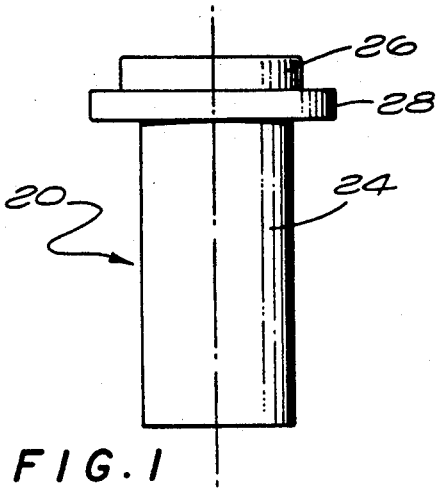
FIG. 1 is a side elevation view of any side of a solid, one-piece ductile rivet designed to be installed using the method described herein, illustrating a novel type of universal head rivet having a two different diameters.

As shown in the drawings for purposes of illustration, the present invention resides in a method of installing a solid one-piece ductile rivet such that no gap will be left between the interface of a rivet 20 (FIG. 1) and a workpiece 22 (FIG. 2), and such that the rivet provides a compressive force or "preload" on the workpiece.

The achievement of a preload during rivet installation using the method of the present invention provides the highly desirable advantages of good corrosion protection for a riveted workpiece as well as higher fatigue life of a riveted joint. Moreover, the present invention provides a method whereby, advantageously, a predictable, quantifiable preload can be achieved in a riveted workpiece because the extent of rivet head deformation that occurs during installation is relatable to the amount of preload obtained.

Further benefits associated with the invention include the compatability of this method with universal head rivet types as well as flush head rivet types. Since the method advantageously utilizes a one-piece rivet, it can be readily executed by an automatic riveting machine. In contrast to prior rivet installation methods which provide preload by using a bi-metallic rivet comprised of two different materials, the present invention is suitable for installing solid one-piece ductile rivets (which are commonly used in the aerospace industry) in a manner subjecting riveted workpieces to a preload. The inventive method is further especially suited for use in aircraft construction because a rivet installed in a manner which subjects the riveted workpiece to a preload will be flushly abutting the underlying workpiece, thereby presenting a more streamlined, aerodynamic profile. Finally, the method of this invention advantageously results in an installed rivet having two deformed, or upset, heads, each of a small height and size which will require little space, thereby leaving more room for the installation and positioning of other components in crowded areas within aircraft and other assemblies.

In accordance with the present invention, a solid one-piece ductile rivet 20 (FIG. 1) is one preferred rivet type suitable for use with the present method. Rivet 20 comprises a cylindrical shank 24 having a preformed or manufactured head 26 at the upper end thereof. The rivet design presented in FIG. 1 differs from conventional rivet designs in a manner which makes the rivet 20 especially suitable for use with the method of the present invention, namely rivet head 26 and its enlarged rim 28 are both coaxial with the shank 24 and are larger in diameter than said shank. The outer rim 28 of the rivet head 26 provides a useful contact point for tooling, as will be discussed hereinafter. The recommended materials that solid rivet 20 (which is not of bi-metallic construction) may be comprised of for use with the method disclosed herein include various grades of aluminum, monel, A-286, Ti/Cb titanium alloys, etc.

Figure 2:
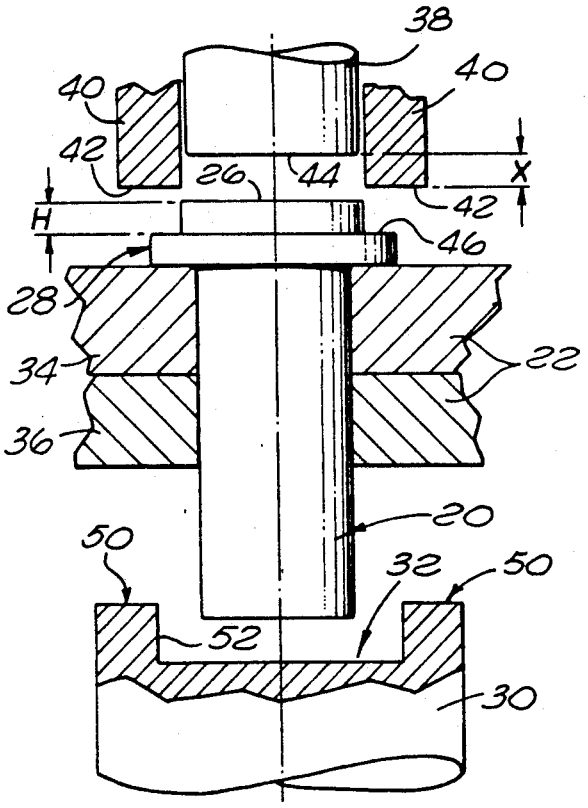
FIG. 2 is a cross sectional view of abutting workpieces about to be fastened together by the universal head rivet of FIG. 1, showing the initial phase of a rivet installation process embodying the invention, wherein an upper tool comprising a central pin and a ring tool, as well as a lower tool having a counterbore, are positioned for engagement with the rivet.

A two-part upper tool assembly, shown in FIG. 2, is provided to install the rivet 20 in the workpiece 22, in conjunction with a lower tool 30 having a counterbore 32 therein. The diameter of the counterbore 32 is chosen so as to be larger than the outside diameter of the rim 28 around the rivet head 26. The depth of the counterbore 32 in the lower tool 30 will determine the height of a lower upset head to be formed in a subsequent step.

In a preparation step shown in FIG. 2, the rivet 20 is introduced into an upper plate 34 and a lower plate 36 comprising the workpiece 22. The two part upper tool assembly comprises an inner tool comprising a piston-like central pin 38 having a flat end face and a cylindrical or ring tool 40 that surrounds the central pin 38 and is slidably mounted thereon. The ring tool 40 has a flat annular end which provides a surface 42. In this preparation step, the central pin 38 and the ring tool 40 are positioned above the rivet head 26 such that the central pin 38 is axially aligned with the rivet 20 and the lower tool 30 is positioned below the rivet shank 24 as shown in FIG. 2.

An important condition of the upper tool assembly for use in installation step #1 is that the axial distance (designated by reference letter "X" in FIG. 2) between the surface 42 of the ring tool 40 and a lower end 44 of the central pin 38 is equal, or approximately equal to, the thickness of the rivet head 26 which lies above the rim 28 (indicated by reference letter "H" in FIG. 2). The central pin end 44 must be maintained at a distance "X" above the ring tool surface 42 throughout installation step #1.

Figure 3:
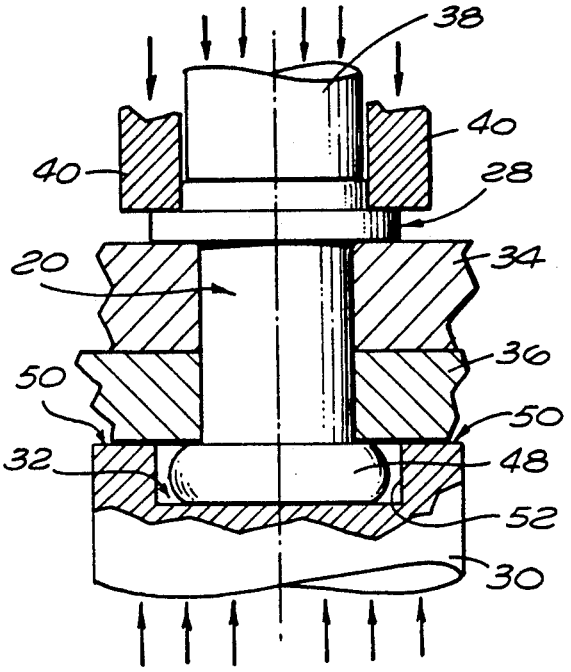
FIG. 3 is a cross sectional view similar to FIG. 2, illustrating engagement of the upper and lower tools with the rivet, thereby deforming the lower tail of the rivet to form a lower upset head.

Installation step #1 begins when the upper tool assembly is lowered to engage the rivet 20 such that the central pin end 44 contacts the top of the rivet head 26, and the end surface 42 of the ring tool 40 contacts upper surfaces 46 of rivet rim 28. The upper tool assembly, comprising central pin 38 and ring tool 40, then holds the rivet 20 in place while upward movement of the lower tool 30 causes the rivet shank to be deformed, or upset, as shown in FIG. 3. During creation of a lower upset head 48, the distal end of rivet shank 24 is first accommodated within the counterbore 32 of the lower tool 30 and then, is deformed into the upset head 48 by continued upward movement by the lower tool 30. Creation of the lower upset head 48 is completed when upper surfaces 50 of the lower tool 30 contact the lower plate 36, as in FIG. 3. This completes installation step #1.

If everything went normally in the first phase, the outside diameter of the rim 28 of the rivet 20 should be unchanged and should be bigger than the outside diameter of the lower upset head 48. The loads during installation step #1 are determined by the upsetting load of the distal end of the rivet shank 24. This upsetting load will vary depending upon the volume of the material contained in the portion of the distal rivet end which protrudes downwardly from the workpiece 22. The volume of the exposed portion of the rivet shank 24 will depend upon the total original rivet shank length and the total thickness of the plates 34 and 36. Since the diameter of the counterbore 32 in the lower tool 30 is chosen to be larger than the outside diameter of the lower upset head 48, and because the lower tool 30 will not accommodate an upset head which is wider than the width of the counterbore 32, the outside diameter of the upset head 48 will not be altered as a consequence of installation step #1. This condition is necessary, as will become apparent hereinafter, to assure that the achievement of preload can be verified and inspected at the end of installation.

With reference to FIG. 3, installation step #1 should end with an upset head 48 which is smaller than the inside diameter of the counterbore 32, however, the size of the upset head 48 must still be larger than the minimum acceptable value prescribed by today's riveting guidelines. If the maximum diameter of the lower upset head 48 touches any inside wall surfaces 52 of the counterbore 32, it is a sign that the length of the rivet shank 24 was not properly chosen and thus must be reduced. Contact between the lower upset head 48 and the wall surfaces 52 can be recognized by marks on the upset head. This contact can produce a loss of the preload when the lower tool 30 is retracted at the end of installation step #2 (to be described hereafter) because retraction may pull the lower upset head 48 away from the lower plate 36 if the counterbore inside wall surfaces 52 grip the upset head.

Figure 4:
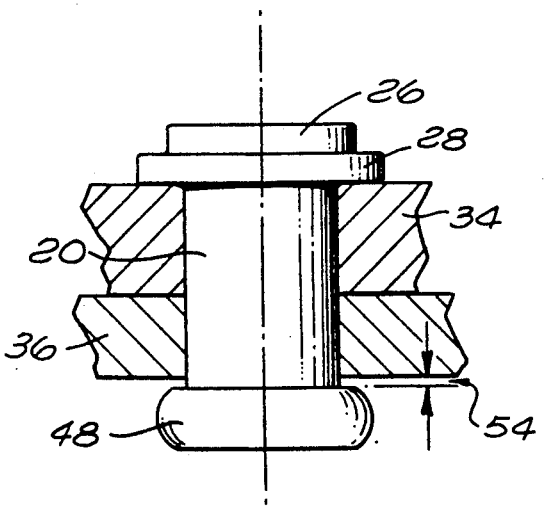
FIG. 4 is a cross sectional view similar to FIG. 3, showing the condition which would exist if the upper and lower tools were removed immediately after the completion of the step illustrated in FIG. 3, namely presence of a small gap between the lower upset head lower workpiece.

If the method was ended after installation step #1, the condition which would exist is pictured in FIG. 4. Note that a gap, indicated by reference numeral 54, would exist between the upset head 48 and the lower plate 36 so that no preload will exist. Gap 54 is a drawback created during conventional rivet installations used currently in the airplane manufacturing industry, but the method of the present invention is specifically designed to eliminate the gap 54 in a manner providing preload upon the workpiece.

Figure 5:
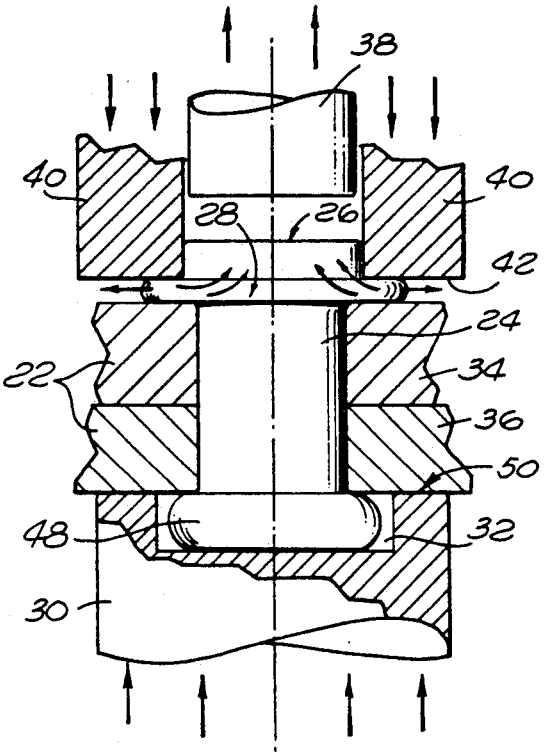
FIG. 5 is a cross sectional view similar to FIG. 3, illustrating a second phase of installation wherein the central pin of the upper tool is retracted while the ring tool compresses an outer rim of an upper manufactured head of the rivet of FIG. 1.

When the upper surface 50 of the lower tool 30 contacts the lower plate 36, as in FIG. 3, the lower tool will encounter a noticeable increase in resistance to its upward movement. This noticeable increase in resistance is detected by means for controlling the upper tool assembly (not shown) and triggers a disengagement and retraction of the central pin 38, as shown in FIG. 5. That is, upon contact of the lower tool 30 with the lower plate 36 of the workpiece, the central pin pressure is relaxed so that the central pin 38 doesn't push downwardly upon the rivet head 26. Retraction of the central pin 38 begins installation step #2.

With reference now to FIG. 5, when the central pin 38 is retracted to begin installation step #2, the rivet shank 24 and the rivet head 26 (which were in compression during step #1) will extend upwardly in the axial direction, thereby increasing in length. This upward extension of the rivet head 26 is indicated by arrows proximate the rivet head in FIG. 5. When the central pin 38 is retracted, the load between the upper ring tool 40 and the lower tool 30 is momentarily diminished. In this condition, the load between the upper ring tool 40 and the lower tool 30 is transmitted through the plates 34 and 36 and the rivet rim 28 which is being compressed between the ring tool and the upper plate 34. That is, the force supplied by tools 30 and 40 will be directed outside the periphery of the rivet shank 24 (i.e. upon the rim 28) rather than through the center of the rivet. This is in contrast to installation step #1 wherein the majority of the load was transmitted through the rivet shank 24.

As installation step #2 progresses, the lower tool 30 will increase the load and the rim 28 of the rivet head 26 will be crushed (to ultimately assume the profile shown in FIG. 6) in a manner causing the material of the rim 28 to flow partly outwardly and partly inwardly, as shown by the arrows proximate the rivet rim 28 in FIG. 5. The portion of material which will flow radially inwardly will help to further relax, or will even put in tension, the rivet shank 24. After installation is completed, a new increased diameter of the rivet rim 28 will permit the size of the maximum load to be determined. The outside diameter of the rivet rim 28 has to reach a certain minimum value to verify that a minimum amount of preload was achieved. The relationship between the size of the outside diameter of crushed rim 28 and the amount of preload is predictable, thus, the present inventive method advantageously allows for the achievement of a measurable preload, a major benefit. The value of the preload can be increased by increasing the maximum load during installation step #2, but only up to a limiting value. Too much of a compression load during step #2 can damage the plates 34 and 36 which are being united, and, in general, can destroy the geometry of the formed joint.

After the compression load in step #2 has reached a preselected maximum value, the load will be relaxed by retracting the ring tool 40 and the lower tool 30. This removal of the compression load will cause the elongated rivet shank 24 to contract, thereby diminishing its length, and will cause the previously compressed plates 34 and 36 to expand, thereby increasing plate thicknesses. A preload will result from this shortening of the rivet shank and an increased plate thickness in the immediate vicinity of the shank.

The first and second steps of the installation are not separated in time. Unlike a preload achieved with a nut and bolt two piece fastening system, the predictability of the preload obtained is much more accurate using the present method. This is because no important friction load interferes in the rivet installation using the inventive method. This is in contrast to two piece fastening systems where the friction loads are an important factor affecting the resultant preload; unfortunately such friction loads are not closely controllable, and thus, achievement of a predictable, measurable preload becomes very difficult using two piece fasteners.

Figure 6:
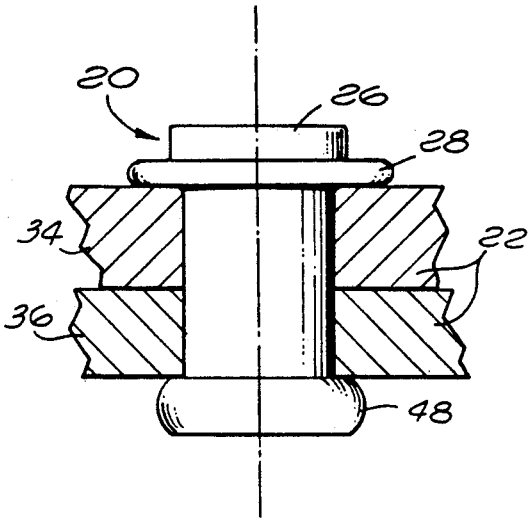
FIG. 6 is a cross sectional view similar to FIG. 4, illustrating a universal head, one piece ductile rivet installed with the method of the present invention, showing an end result wherein preload exists and both the lower tail and the outer rim of the upper head are deformed.

The result of installation steps 1 and 2 is shown in FIG. 6, namely, provision of a rivet 20 which subjects the joined workpiece 22 to a preload. The outside profile and size of the squashed rim 28 assures the existence of a preload.

Figure 7:
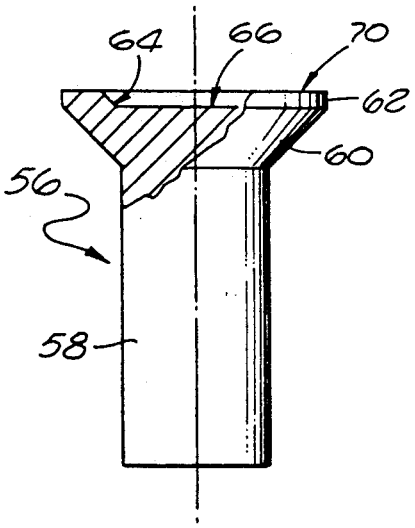
FIG. 7 is a side elevational view, partially in cutaway of a countersink, or flush, head rivet suitable for installation with the method of the present invention.

A flush head solid ductile rivet 56 suitable for use with this method is shown in FIG. 7. The rivet 56 has a shank 58 having a coaxial tronconical head 60 that terminates in a short cylindrical portion 62. Atop the cylindrical portion 62, in a position which is coaxial with the rivet shank 58, is a depression defined by a tronconical lateral surface 64 which ends in a circular bottom 66. The installation of a flush head rivet 56 is basically the same as the installation of the rivet 20. The difference is in the shape of the tooling. For installation of the flush head rivet 56, the upper central pin 38 has a tronconical portion 68 sized to fit in the depression provided in the flush head rivet 56.

Figure 8:
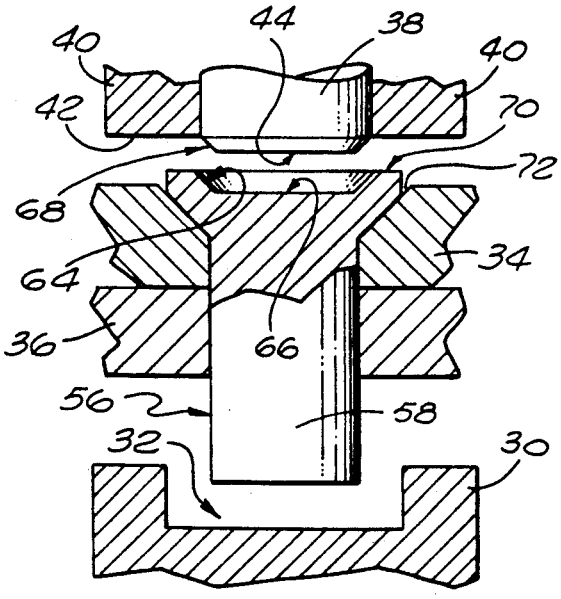
FIG. 8 is a cross sectional view of abutting workpieces about to be fastened together by the countersink, or flush, head rivet of FIG. 7, showing the initial phase of a rivet installation process embodying the invention, wherein an upper tool comprising a central pin and a ring tool, as well as a lower tool having a counterbore, are positioned for engagement with the rivet.

Step #1 of installing the flush head rivet 56 in a manner resulting in preload is preceded by a preparation step illustrated in FIG. 8, wherein the upper tool assembly comprising the central pin 38 and the ring tool 40 is positioned above the rivet 56 such that the central pin 38 is axially aligned with the rivet. The lower tool 30 is also positioned for engagement of the shank of the rivet 56 in the counterbore 32 of said lower tool. This preparation step is similar to the positioning step described in reference to FIG. 2.

Figure 9:
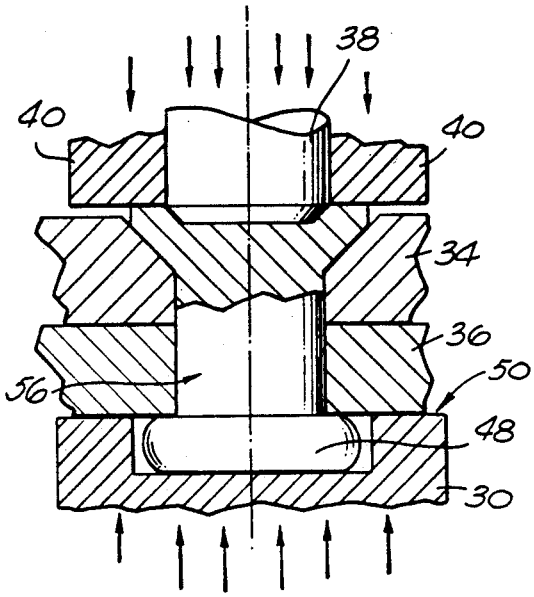
FIG. 9 is a cross sectional view similar to FIG. 8, illustrating engagement of the upper and lower tools with the rivet, thereby deforming the lower tail of the rivet to create a lower upset head.

The central pin 38 and the ring tool 40 are lowered simultaneously (see FIG. 9) to begin installation step #1. Ultimately, the lower surface 42 of the ring tool 40 will contact top surface 70 of the rivet 56, the tronconical surface 68 of the central pin 38 will contact the tronconical surface 64 of the rivet, and the end 44 of the central pin 38 will contact the bottom 66 of the depression in the rivet 56, as illustrated in FIG. 9.

During installation step #1, the central pin 38 and the ring tool 40 will maintain the tronconcial head 60 of the rivet 56 in a state wherein said head 60 is pressed against a countersink surface provided in the upper plate 34 while the central pin 38 and the ring tool 40 resist the loads developed during deformation of the shank end of rivet 56 by the continued upward movement of the lower tool 30. The lower tool 30 will continue to deform the shank end of rivet 56 (thereby producing lower upset head 48) until the upper surface 50 of the lower tool contacts the lower plate 36, thus ending step #1, as shown in FIG. 9.

Figure 10:
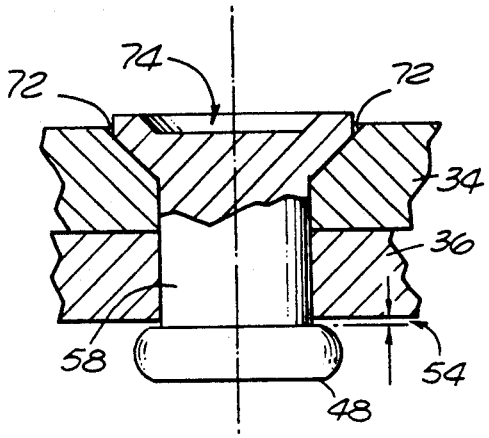
FIG. 10 is a cross sectional view similar to FIG. 1, showing the condition which would exist if the upper and lower tools where removed immediately after the completion of the step illustrated in FIG. 9, namely presence of a small gap between the lower upset head and the lower workpiece.
Figure 11:
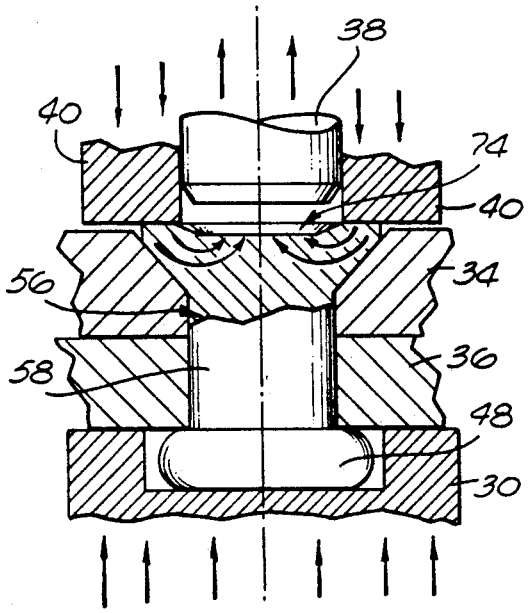
FIG. 11 cross sectional view similar to FIG. 9, illustrating a second phase of installation wherein the central pin of the upper tool is retracted while the ring tool compresses rim portions of the rivet head such that the countersink of the rivet head is partially filled.

When the lower tool 30 begins pushing against the lower plate 36, a detectable increase in the load is created. This load increase is sensed by a mechanism (not shown) holding the central pin 38. In response, the central pin 38 is retracted by its holding mechanism, as shown in FIG. 11, thereby alleviating the load which central pin 38 had been applying upon the rivet head 60. If all tooling were removed at the moment of retraction of the central pin 38, no preload will be achieved in the workpiece because of the presence of a gap 54 (see FIG. 10) at the interface of the lower upset head 48 and the lower plate 36. Hence, the second step becomes a necessity if preload is to be obtained.

Upon retraction of the central pin 38, as shown in FIG. 11, installation step #2 begins. The downward pressure on the ring tool is increased and the rivet material lying below the cylindrical rim portion 62 of the rivet 56 is forced to move partially radially outwardly, thereby filling up a conical surface 72 (FIG. 10) defining a countersink in the upper plate 34. Moreover, continued downward pressure is applied by the ring tool 40 until the rivet material moves radially inwardly (as indicated by arrows in FIG. 11) to fill in the countersink 74 provided in the tronconical head 60 of the rivet 56.

Figure 12:
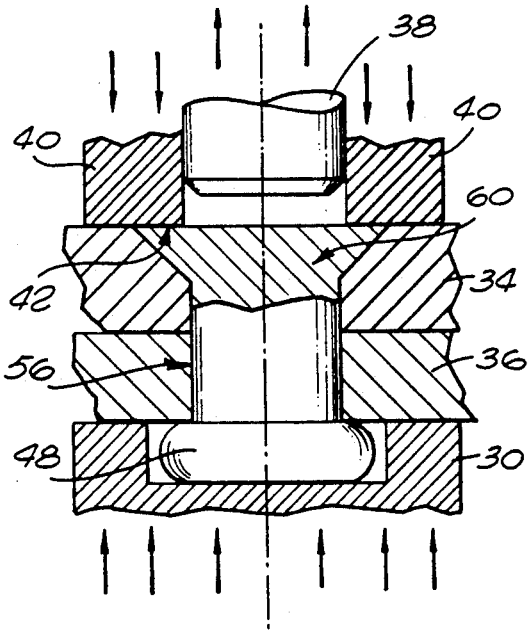
FIG. 12 is a cross sectional view similar to FIG. 11, illustrating a stage in the second phase of installation, wherein the ring tool becomes flush with the upper workpiece thereby pushing the material from the rivet rim radially inside the rivet head countersink to completely fill the countersink.

With the central pin 38 retracted during installation step #2, a compression load sufficient to crush the upper portion of rivet head 60 is transmitted by the tooling through the material of plates 34 and 36 which surround the rivet shank 58. This peripheral application of force (i.e. no compression force on shank 58 during step #2) which occurs during the analogous steps illustrated in FIGS. 5, 11 and 12 is advantageous in that the shanks 24 and 58 of the rivets 20 and 56 are not compressed during step #2. This is in contrast to conventional installation methods which do apply compressive pressure through the center axis of a rivet, thereby undesirably compressing the rivet shank such that, upon release of a centrally rather than peripherally directed force, the compressed shank will expand due to its elastic memory and thus, a gap will be formed at the rivet/-workpiece interface and preload will not be obtained. Therefore, the peripheral application of compressive force in step #2 of the present invention is important and is made possible through use of a lower tool 30 having a counterbore 32, as well as by retraction of the central pin 38.

Since the application of force in step #2 is focused peripherally around the rivet shank 58, the shank can relax partially. At the end of installation step #2, when all tooling is retracted, a preload will be achieved when the elastic memory of the compressed material of plates 34 and 36 causes the plates to try to expand and return to their original thickness around the shank. Since the shank was not compressed to the extent of the plates 34 and 36, it will not expand to the degree which the plates will attempt to expand (especially since the shank is partially relaxed in step #2 while the plates are further compressed). As a result, the attempted expansion of compressed plates 34 and 36 will be constrained by the installed rivet 20 or 56 and a preload will exist.

Assuming that equally sized compression loads are used in the installation of each, the preload achievable during installation of the rimmed head rivet 20 will be greater than the preload achievable during installation of the flush head rivet 56.

The magnitude of preload obtained through use of the methods discussed herein depends upon the rivet material, the material of the workpiece plates, and the magnitude of the loads used during the installation process. As noted previously, high loads can damage the geometry of the joint. Advantageously, this method eliminates friction factors that conventionally hinder the achievement of a quantifiable preload so that the only resistance to preload application is the strength of the material comprising the rivet. As an example of the preload obtained with the new invention applied to aluminum rivets with a universal head manufactured from 2117 material (MS20470AD6), a preload of 450 lbs. is consistently achieved with a first step and second step compression load of 4000 lbs., using tools dimensioned as explained with reference to FIG. 18.

Figure 13:
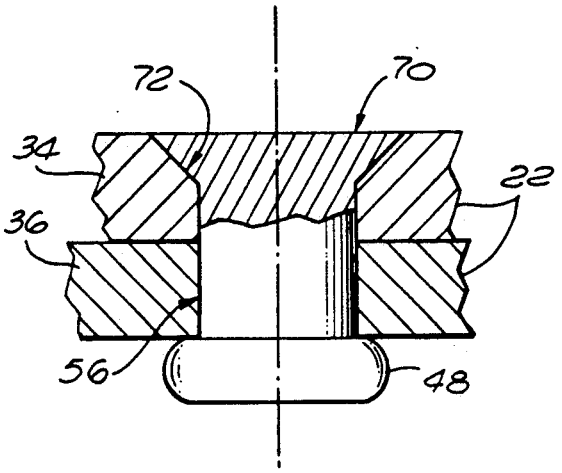
FIG. 13 is a cross sectional view similar to FIG. 10, illustrating a or flush, rivet installed with the method of the invention, showing an end result wherein preload exists and deformed rivet rim portions completely fill the countersink of the workpiece.

FIG. 12 illustrates the end of step #2 of the installation of a flush head rivet 56. Note that the end surface 42 of the ring tool 40 is contacting the upper plate 34 and the countersink 74 of the rivet head 60 has been completely filled during deformation of the rivet 56. The countersink 74 (best seen in FIG. 11) may be only partially filled up by flowing rivet material if the preparation of the countersink 72 in the upper plate 34 and the dimensions of the rivet head 60 were not precisely executed. Upon removal of the upper and lower tooling, the installed flush head solid rivet 56 will have a cross sectional profile as shown in FIG. 13. Note in FIG. 13 that preload has been achieved (and hence, no gap appears at the interface of the rivet 56 and the workpiece 22) and the countersink 72 of the upper plate 34 is completely filled up, thereby providing a highly desirable flushness of the rivet top surface 70 with the workpiece that is well within today's acceptable limits. This flushness of the upper rivet and workpiece surfaces is advantageous in that no gaps exist for the collection of potentially corroding moisture and the smooth continuous surface achieved is aerodynamically desirable in aircraft construction.

Figure 14:
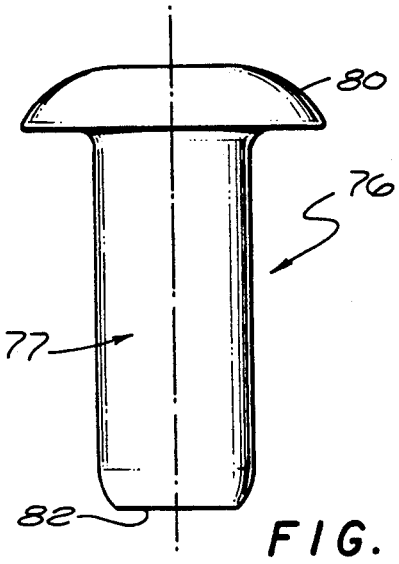
FIG. 14 is elevation view of a solid ductile universal head rivet typically used in the manufacturing of aircraft.
Figure 15:
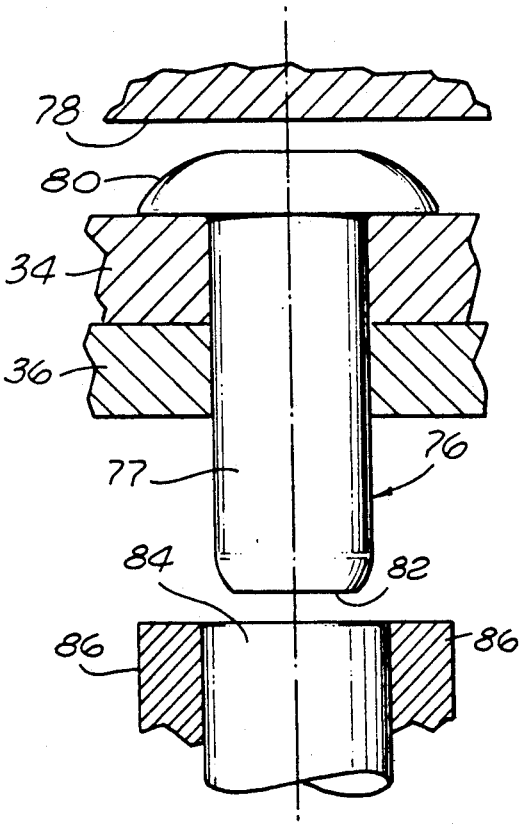
FIG. 15 (PRIOR ART)
FIG. 15 is art cross sectional view of abutting workpieces about to be fastened together by the universal head rivet of FIG. 14, showing the initial phase of a prior art rivet installation process, wherein a lower tool comprising a central pin and a ring tool, as well as an upper flat tool, are positioned for engagement with the rivet; note that this prior art arrangement lacks a tool having a counterbore and utilizes a central pin and ring tool below the workpieces rather than above them.
Figure 16:
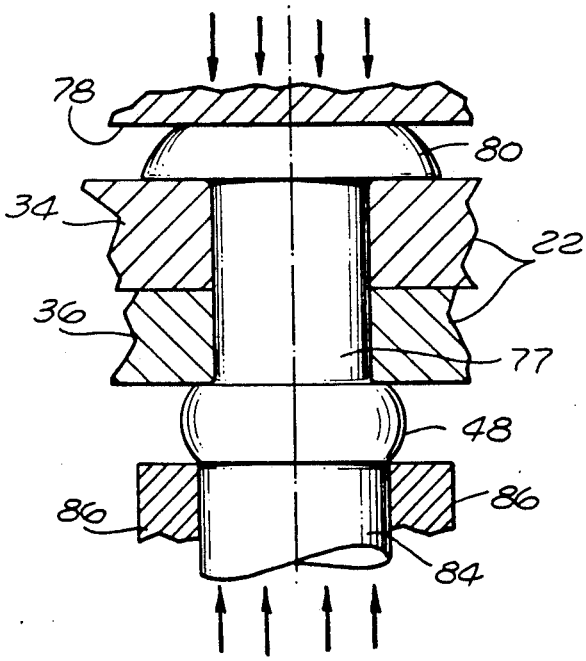
FIG. 16 (PRIOR ART)
FIG. 16 is a cross sectional view similar to FIG. 15, illustrating a first phase of a prior art rivet installation method, showing engagement of the upper and lower tools with the rivet, thereby deforming a lower portion of the rivet to form a lower upset head.
Figure 17:
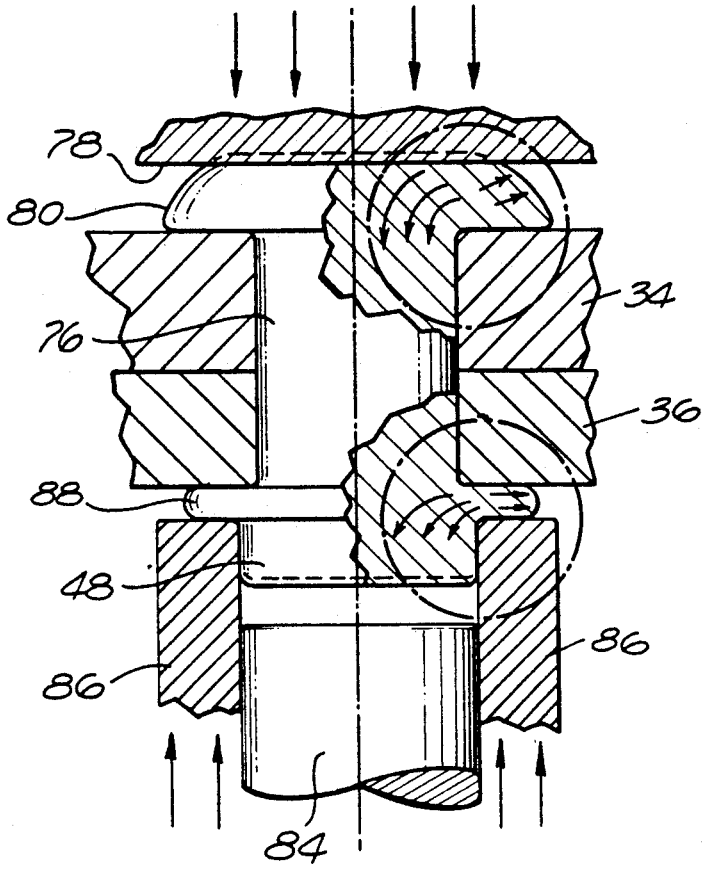
FIG. 17 (PRIOR ART)
FIG. 17 is cross sectional view similar to FIG. 16, illustrating a second phase of a prior art rivet installation method, wherein the central pin of the lower tool is retracted while the ring tool compresses the lower upset head to form a rim therearound.
Figure 17A:
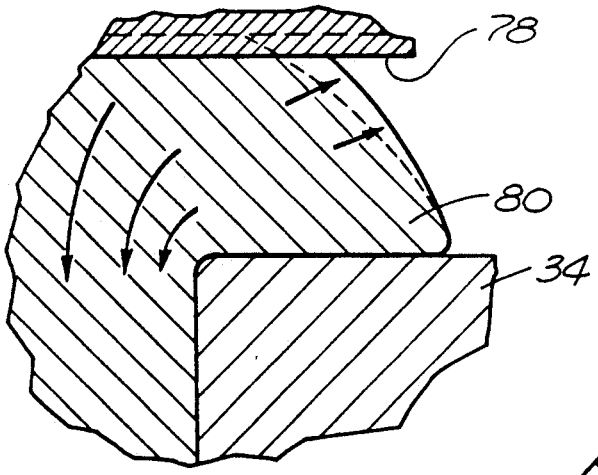
FIG. 17A (PRIOR ART)
Figure 17B:
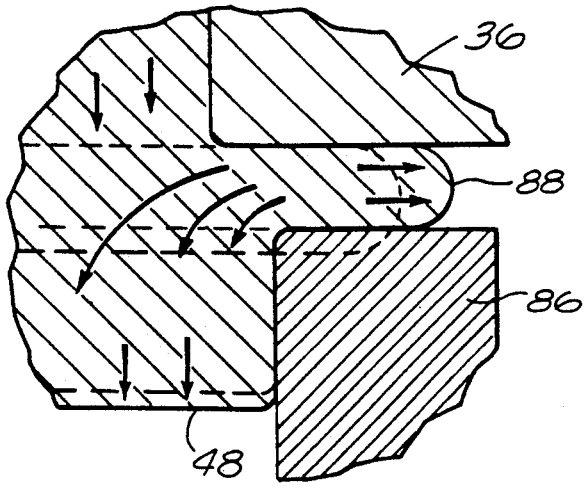
FIG. 17B (PRIOR ART)

Now that the method of the present invention has been described, an analysis of FIGS. 15–17(*b*) will provide insight into why preload is difficult to achieve when a solid ductile rivet (not a bi-metallic rivet) is installed using prior art methods. Such a solid ductile universal head rivet 76, conforming to standards of today's airplane manufacturing industry, is illustrated in FIG. 14.

The prior art preparation step is depicted in FIG. 15, and shows the rivet 76 having its shank 77 positioned in the upper and lower plates 34 and 36 with an upper flat tool 78 positioned above a head 80 of the rivet 76 and a two piece lower tool assembly positioned beneath a rivet shank end 82. The lower tool assembly comprises a lower central pin 84 surrounded by a ring tool 86 slidably mounted thereon. Note that the tooling arrangement depicted in FIGS. 15–17(*b*) conforms to my prior U.S. Pat. No. 4,688,317, with the exception that the prior art tooling arrangement of FIGS. 15–17(*b*) is upside-down compared to the tooling arrangement of the present invention. Note also that the prior art tooling opposite the two-piece tooling assembly (upper flat tool 78 in FIG. 15) does not contain a counterbore as does lower tool 30 of the invention.

Prior art step #1 is depicted in FIG. 16, wherein an upset head 48 is formed by the compression forces applied to the rivet 76 by the upper flat tool 78 and the lower central pin 84.

Prior art step #2 is depicted in FIG. 17, wherein the lower central pin 84 is retracted while the lower ring tool 86 continues to apply compressive force to the upset head 48, thereby shaving and crushing outside portions of the upset head in a manner forming an upset head rim 88. The second installation step ends upon completion of the formation of the upset head rim 88.

In order to understand why the prior method of FIGS. 15–17 is not suitable for obtaining preload during installation of solid, one-piece ductile rivets, a closer look presented in FIGS. 17(*a*) and (*b*) is necessary. FIG. 17(*a*) shows the flow (with arrows) of material in the rivet head 80 during the formation of the upset head rim 88, while FIG. 17(*b*) depicts the flow (with arrows) of material from the rim 88 during the end of prior art step #2. In FIG. 17(*b*), it appears that inwardly radially flowing material from upset head rim 88 (see arrows) will help to relax the shank 77 of the rivet 76, however, because the rivet head 80 is collapsing, as shown in FIG. 17(*a*), the head material is pushed into the aperture in the upper plate 34, (see arrows) and the shank 90 is elongated by an excessive amount. Consequently, no preload will result at the end of installation because the collapse of the rivet head 80 illustrated in FIG. 17(*a*) pushes extra material from the rivet head 80 into the rivet shank 77, thereby elongating the rivet shank such that a gap will result at the rivet/workpiece interface. Since the collapse of the rivet head 80 is instrumental in preventing preload in the prior method of FIGS. 14–17(*b*), the use of a rivet having a hard material for the rivet head 80 (such as the rivet head material of the rivet sold under the trademark "CHERRYBUCK") will prevent the rivet head 80 from collapsing during step #2, and thus, a preload will exist. Thus, it should be apparent that, although hard material rivets may be suitable for installation in a manner obtaining preload using prior methods, solid ductile rivets will not be suitable for the achievement of a preload because a ductile rivet head will collapse during step #2 of prior methods, thereby elongating the rivet shank and creating the afore-mentioned gap which the present method avoids.

A further advantage of the method of the present invention can be seen by viewing FIG. 3, illustrating engagement of both the lower and upper tools with the rivet being installed, and FIG. 16, which shows an engagement step in a prior art method. In the inventive method (FIG. 3), a concentric alignment of the central pin 38 with the shank 20 and workpiece apertures is assured for the upper tool assembly because the rivet 20 (FIG. 1), which is specially designed for use with this inventive method, has a two-tiered head shape configured such that rivet head 26 and rivet head rim 28 define a shoulder which retains and aligns the ring tool 40 (as in FIG. 3) in a manner that maintains a concentric alignment of the central pin 38 and the rivet 20. In the prior method of FIG. 16, the portion of the rivet which engages the lower two piece tool assembly does not provide a shoulder for maintaining the lower ring tool 86 in a desired alignment and hence, the potential exists for the lower central pin 84 to be misaligned in a nonconcentric arrangement with the rivet shank 76 and workpiece apertures. In actuality, a longstanding problem in this art is the difficulty of establishing and maintaining a concentric alignment of the two piece tool assembly (comprising a central pin and outer ring tool) with the holes in the plates comprising the workpiece. This problem is accentuated in the aerospace industry because conventional rivet installation methods utilized therein employ huge automatic riveters that have long arms which install a rivet using a somewhat lengthy sweeping motion. Unfortunately, the wide range of motion which these riveter arms undergo readily gives rise to slight variances in the arms' movement path, thereby leading to an ultimate misalignment of the tooling with the rivet and workpiece holes. The reason that this concentricity of tooling and rivet/workpiece is important is that, if, for example, in FIG. 16, the central pin 84 was off center with respect to the longitudinal axis of the rivet 76, the upset head 48 formed will also not be concentric with the holes through plates 34 and 36, and, disadvantageously, no preload will result from installation. The method of the present invention offers the improvement of utilizing a uniquely designed rivet and method steps which provide means for maintaining the desirable concentric alignment just described. The present method's provision for maintaining a concentric alignment of the central pin 38 (FIG. 3) with the rivet shank 24 is extremely conducive in the achievement of a preload. Moreover, the counterbore 32 of the lower tool 30, being of a larger diameter than the rivet shank 24 or the upset head 48 to be formed, permits a certain maintainable eccentricity in the relationship between the lower tool and the rivet 20, thereby advantageously alleviating alignment constraints upon the lower tool 30 during the engagement step.

Figure 18:
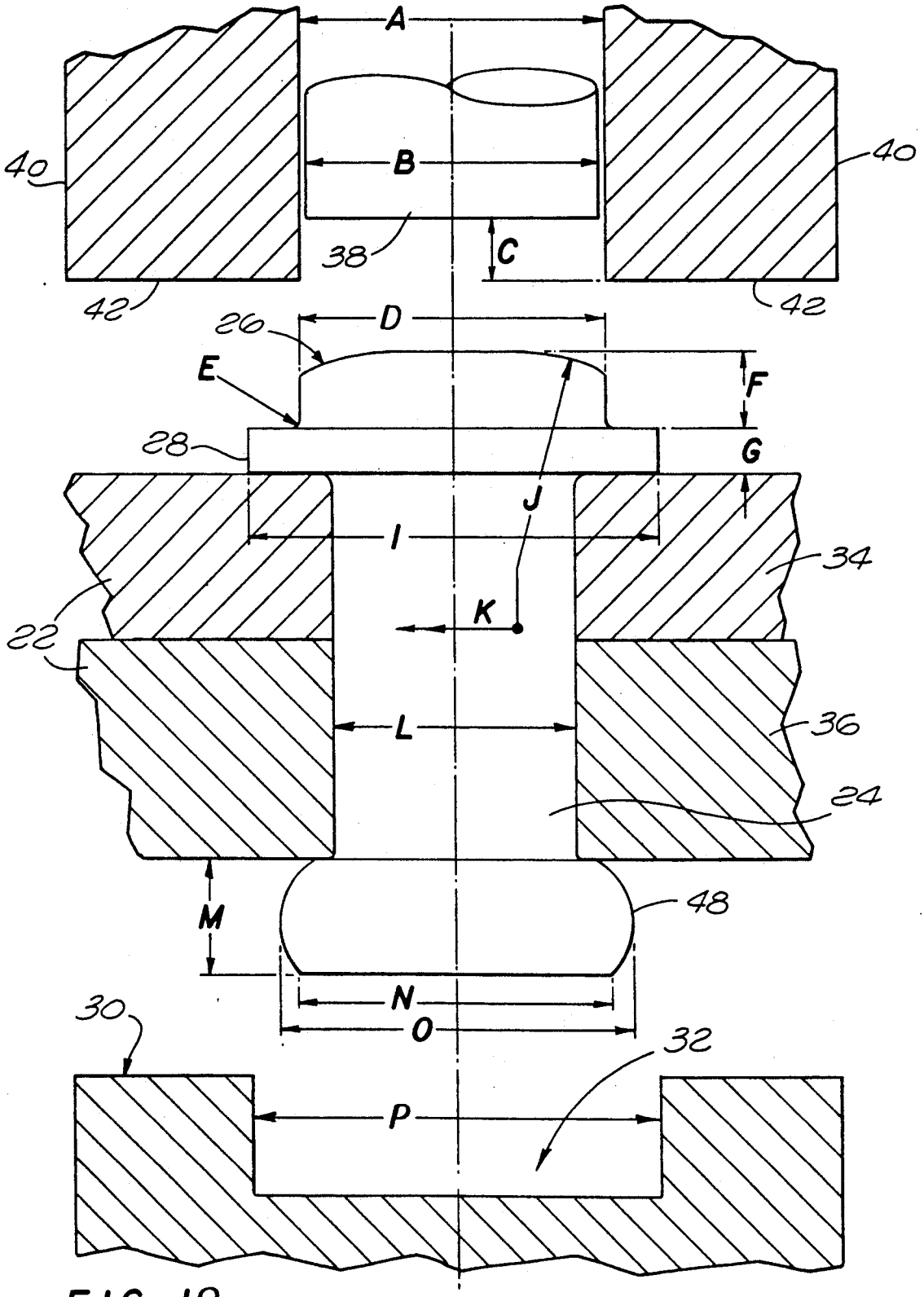
FIG. 18 is an enlarged cross section view of a universal head rivet at the end of the phase shown in FIG. 3.

The relationships between rivet configuration and tooling dimensions is a factor worth noting in the present method because solid ductile rivet installation in a manner providing preload can be an endeavor in precision at times. For this reason, FIG. 18 presents an illustrative example of tooling and rivet dimensions which smoothly allow the achievement of a preload using the method of this invention. It should be understood that this example is merely illustrative and that the scale of this method could be changed to encompass a myriad of other dimensions, however the general size relationships which can be garnered from the dimensions presented in the following listing are instructive as general guidelines for the appropriate sizing of tooling and rivets.

| FIG. 18 Reference Letter | Corresponding dimension (in inches) |
|---|---|
| A | 0.240 |
| B | 0.238 |
| C | 0.050 |
| D | 0.238 |
| E | 0.005–0.010R |
| F | 0.055 |
| G | 0.035 |
| I | 0.320 |
| J | 0.164 |
| K | 0.093 |
| L | 0.187 |
| M | 0.090 |
| N | 0.260 |

-continued

| FIG. 18 Reference Letter | Corresponding dimension (in inches) |
|---|---|
| 0 | 0.310 |
| P | 0.320 |

From the foregoing it will be appreciated that the method to obtain preload in solid one-piece ductile rivet installation as set forth in the present invention advantageously is compatible with both universal head type rivets and flush head type rivets and can be executed by automatic riveting machines. Moreover, the novel rivet design especially suited for use in this inventive method provides an alignment shoulder which maintains tooling in a desirable relationship which is concentric with whichever hole is accommodating the rivet to be installed. Most importantly, the present method provides for the achievement of a preload that is predictable, quantifiable and verifiable, all highly desirable qualities. Moreover, this preload can be obtained using solid one-piece ductile rivets rather than the bi-metallic rivets conventionally used in prior methods involving preload. The preload achievable with this invention provides a good defense against corrosion because gaps between the rivet and workpiece are avoided, thereby eliminating pockets where corrosive moisture can collect. Finally, the preload resulting from use of the present method will ensure a higher fatigue life of a joint riveted by use of the invention. The present method deviates from conventional rivet installation methods in a number of ways which make the above advantages possible, with main examples being the use of solid ductile rivets, the practice of deforming both ends of a rivet, in part, through the use of a peripherally applied compressive force, to achieve preload, and the use of a specially designed rivet having a two-tiered rivet head with each tier having a diameter larger than the shank diameter.

While a particular form of the invention has been illustrated and described, it will be apparent that various modifications can be made without departing from the spirit and scope of the invention. Accordingly, it is not intended that the invention be limited, except as by the appended claims.

I claim:

1. A method of installing a rivet to provide an axial preload on two or more workpieces joined by the rivet, the rivet having a shank, a head on one end of the shank and a tail on the other end of the shank, the method comprising the steps of:

inserting the rivet tail and shank through aligned holes in two or more stacked workpieces with the rivet tail extending beyond the face of one of the workpieces;

providing a two piece tooling assembly comprising an outer tool and an inner tool, with said outer tool having an end face with a cylindrical opening therein in which said inner tool is slidably mounted, and positioning said two piece tooling assembly proximate the rivet head;

providing a tool having a counterbore surface and positioning said counterbore surface proximate the rivet tail;

engaging said rivet head with said tooling assembly such that said inner tool exerts an axially compressive force upon the rivet head and the outer tool exerts a compressive force upon peripheral portions of said rivet head, and engaging said rivet tail with said counterbore surface while said tool assembly engages said rivet head;

deforming said rivet tail with an axially compressive force supplied thereto by said counterbore surface, said step of rivet tail deformation continuing until material comprising the rivet tail is deformed radially outwardly to form a first upset head having a diameter which is greater than that of the rivet shank and the diameter of the hole through the adjacent workpiece;

discontinuing the axially compressive force applied to the rivet head by removing the inner tool from contact therewith while said outer tool and said counterbore surface continue to supply compressive force to said peripheral rivet head portions and said first upset head, respectively; and applying continued compressive force upon said peripheral rivet head portions using said outer tool until material comprising said peripheral rivet head portions begins to flow radially outwardly in a manner creating an enlarged rim about said rivet head; and increasing the compressive force upon the rim to further flatten and deform the peripheral rivet head portions, thereby forming a second upset head.

2. A method as set forth in claim 1, wherein the step of providing a tool having a counterbore surface includes providing a tool with a counterbore surface defined by one piece continuous surface.

3. A method as set forth in claim 1, further including the steps of:

providing a rivet having a manufactured head of a predetermined thickness "X"; and spacing an end surface of the inner tool above the end face of the outer tool by a distance equal to "X" during execution of the steps of engaging said rivet head with said tooling assembly, engaging said rivet tail with said counterbore surface, and deforming said rivet tail to form the first upset head.

4. A method as set forth in claim 1, further including an initial step of providing a rivet having a top head portion that is larger in diameter than said shank, and a central head portion between said top head portion and said shank, said central head portion having a rim about its periphery that is larger in diameter than said top head portion and that is also larger in diameter than said shank.

5. A method as set forth in claim 4, wherein the step of engaging said rivet head with said tooling assembly includes the steps of contacting said rim with said outer tool and contacting said top head portion with said inner tool such that said inner tool is aligned concentrically with the aligned holes in said workpieces.

6. A method as set forth in claim 1, further including an initial step of providing a solid one-piece ductile rivet.

7. A method of installing a rivet to provide an axial preload on two or more workpieces joined by the rivet, the rivet having a shank, a head on one end of the shank and a tail on the other end of the shank, the method comprising the steps of:

inserting the rivet tail and shank through aligned holes in two or more stacked workpieces with the rivet tail extending beyond the face of one of the workpieces;

providing a two piece tooling assembly comprising an outer tool and an inner tool, with said outer tool having an end face with a cylindrical opening therein in which said inner tool is slidably mounted, and positioning said two piece tooling assembly proximate the rivet head;

providing a tool having a counterbore surface and positioning said counterbore surface proximate the rivet tail;

engaging said rivet head with said tooling assembly such that said inner tool exerts an axially compressive force upon the rivet head while the outer tool simultaneously exerts a compressive force upon peripheral portions of said rivet head, and engaging said rivet tail with said counterbore surface while said tool assembly simultaneously engages said rivet head;

deforming said rivet tail with an axially compressive force supplied thereto by said counterbore surface, said step of rivet tail deformation continuing such as to cause material comprising the rivet tail to be deformed radially outwardly to form a first upset head having a diameter which is greater than that of the rivet shank and the diameter of the hole through the adjacent workpiece;

continuing application of an axially compressive force supplied to said rivet tail by said counterbore surface such that rivet tail deformation allows said tool having a counterbore surface to contact the workpiece face through which said rivet tail extends;

discontinuing the axially compressive force applied to the rivet head by removing the inner tool from contact therewith, said step of discontinuing being executed such that discontinuance of the axially compressive force occurs when the tool having a counterbore surface contacts said workpiece face;

continuing to supply compressive force to said peripheral rivet head portions and said first upset head using said outer tool and said counterbore surface, respectively, while executing said discontinuing step;

applying continued compressive force upon said peripheral rivet head portions using said outer tool until material comprising said peripheral rivet head portions begins to flow radially outwardly in a manner creating an enlarged rim about said rivet head; and increasing the compressive force upon the rim to further flatten and deform the peripheral rivet head portions, thereby forming a second upset head.

8. A method as set forth in claim 7, wherein the step of providing a tool having a counterbore surface includes providing a tool with a counterbore surface defined by a one piece continuous surface.

9. A method as set forth in claim 7, wherein the step of increasing the compressive force upon the rim includes forming a second upset head having an outside diameter, said outside diameter having a size that is relatable in a predictable manner to the amount of axial preload achieved.

10. A method of installing a rivet to provide an axial preload on two or more workpieces joined by the rivet, the rivet having a shank, a head on one end of the shank and a tail on the other end of the shank, the method comprising the steps of:

inserting the rivet tail and shank through aligned holes in two or more stacked workpieces with the rivet tail extending beyond a first face of a first workpiece of the stacked workpieces and the rivet head protruding from a second face of a second workpiece of the stacked workpieces;

providing a two piece tooling assembly comprising an outer tool and an inner tool with said outer tool having an end face with a cylindrical opening therein in which said inner tool is slidably mounted, and positioning said two piece tooling assembly proximate the rivet head and adjacent to said second face;

providing a tool having a counterbore surface and positioning said counterbore surface proximate the rivet tail and adjacent to said first face;

engaging said rivet head with said tooling assembly such that said inner tool exerts an axially compressive force upon the rivet head while the outer tool simultaneously exerts a compressive force upon peripheral portions of said rivet head, and engaging said rivet tail with said counterbore surface while said tooling assembly simultaneously engages said rivet head;

deforming said rivet tail with an axially compressive force supplied thereto by said counterbore surface, said step of rivet tail deformation continuing such as to cause material comprising the rivet tail to be deformed radially outwardly to form a first upset head having a diameter which is greater than that of the rivet shank and the diameter of the hole through the adjacent workpiece;

continuing application of an axially compressive force supplied to said rivet tail by said counterbore surface such that rivet tail deformation allows said tool having a counterbore surface to contact said first face;

discontinuing the axially compressive force applied to the rivet head by removing the inner tool from contact therewith, said step of discontinuing being executed such that discontinuance of the axially compressive force occurs simultaneous with contact of the first face by the tool having a counterbore surface;

continuing to supply compressive force to said peripheral rivet head portions and said first upset head using said outer tool and said counterbore surface, respectively, while executing said discontinuing step;

applying continued compressive force upon said peripheral rivet head portions using said outer tool until material comprising said peripheral rivet head portions begins to flow radially outwardly in a manner creating an enlarged rim about said rivet head; and increasing the compressive force upon the rim to further flatten and deform the peripheral rivet head portions, thereby forming a second upset head;

wherein said initial step of inserting the rivet through the workpiece includes the step of providing a solid one-piece ductile rivet that is not of a bi-metallic construction.

11. A method of installing a rivet as set forth in claim 10, wherein said step of providing a solid one-piece ductile rivet includes providing a rivet having a top head portion that is larger is diameter than said shank, and a central head portion between said top head portion and said shank, said central head portion having a rim about its periphery that is larger in diameter than said top head portion and that is also larger in diameter than said shank; and wherein said step of engaging the rivet head with the tooling assembly includes engaging the top head portion with the inner tool while simultaneously engaging the central head portion with the outer tool.

* * * * *